US009880484B2

(12) United States Patent
Tazaki

(10) Patent No.: US 9,880,484 B2
(45) Date of Patent: Jan. 30, 2018

(54) CHARGING MEMBER, INTERMEDIATE TRANSFER BELT AND IMAGE FORMING APPARATUS HAVING THE SAME

(71) Applicant: FUJI XEROX CO., LTD., Tokyo (JP)

(72) Inventor: Yohei Tazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,091

(22) Filed: Aug. 2, 2016

(65) Prior Publication Data

US 2017/0212444 A1 Jul. 27, 2017

(30) Foreign Application Priority Data

Jan. 21, 2016 (JP) ..... 2016-009489

(51) Int. Cl.
*G03G 15/02* (2006.01)
*G03G 15/16* (2006.01)

(52) U.S. Cl.
CPC ..... *G03G 15/0258* (2013.01); *G03G 15/0216* (2013.01); *G03G 15/0225* (2013.01); *G03G 15/161* (2013.01)

(58) Field of Classification Search
CPC ..... G03G 15/0258; G03G 15/161; G03G 15/0216; G03G 15/0225
See application file for complete search history.

(56) References Cited

U.S. PATENT DOCUMENTS

2005/0019057 A1* 1/2005 Mizusawa ..... G03G 15/0258 399/100
2008/0187361 A1* 8/2008 Sakagawa ..... G03G 15/0258 399/176
2011/0008069 A1* 1/2011 Matsushita ..... G03G 15/161 399/127
2014/0086601 A1* 3/2014 Hoshino ..... G03G 15/0258 399/34
2015/0093143 A1* 4/2015 Funatani ..... G03G 21/12 399/101

FOREIGN PATENT DOCUMENTS

JP 2009-265249 A 11/2009

* cited by examiner

*Primary Examiner* — Rodney Bonnette
(74) *Attorney, Agent, or Firm* — Sughrue Mion, PLLC

(57) ABSTRACT

An image forming apparatus includes a cleaning device located, in a direction in which an intermediate transfer belt rotates, downstream of a second transfer position and upstream of a first transfer position, at which a first transfer device transfers a toner image onto the intermediate transfer belt, the cleaning device cleaning the intermediate transfer belt; and a charging member located upstream of the first transfer position and downstream of the cleaning device in the direction in which the intermediate transfer belt rotates, the charging member having a shape of a roller having a diameter smaller than a diameter of a driving roller that drives the intermediate transfer belt to rotate the intermediate transfer belt, the charging member charging the intermediate transfer belt by holding the intermediate transfer belt between the charging member and the driving roller and touching an outer surface of the intermediate transfer belt.

20 Claims, 2 Drawing Sheets

CHARGING MEMBER, INTERMEDIATE TRANSFER BELT AND IMAGE FORMING APPARATUS HAVING THE SAME

CROSS-REFERENCE TO RELATED APPLICATIONS

This application is based on and claims priority under 35 USC 119 from Japanese Patent Application No. 2016-009489 filed Jan. 21, 2016.

BACKGROUND

Technical Field

The present invention relates to image forming apparatuses.

A highly-resistive intermediate transfer belt is used for, for example, improving the graininess of an image. The use of this intermediate transfer belt increases the likelihood of an image defect called a ghost, which is a phenomenon of an appearance of a previously formed image on the currently formed image due to an electrostatic record remaining on the intermediate transfer belt. To prevent the occurrence of a ghost, the intermediate transfer belt requires uniform recharging using, for example, a charging brush. However, applying a charging brush or the like to the intermediate transfer belt may cause an image defect of a fine white streak attributable to an additive used when toner having a small toner weight is used for image formation.

SUMMARY

According to an aspect of the invention, an image forming apparatus includes an image carrier that allows an electrostatic latent image to be formed thereon and holds a toner image into which the electrostatic latent image is developed with toner; an intermediate transfer belt that allows the toner image on the image carrier to be transferred thereto and transports the toner image while rotating; a first transfer device that transfers the toner image on the image carrier onto the intermediate transfer belt; a second transfer device that transfers the toner image on the intermediate transfer belt onto a sheet; a fixing device that fixes, onto the sheet, the toner image that has been transferred onto the sheet; a sheet transport unit that transports the sheet such that the sheet moves along a transport path via a second transfer position, at which the second transfer device transfers the toner image onto the sheet, and a fixing position, at which the fixing device fixes, onto the sheet, the toner image onto the sheet; a cleaning device that is located, in a direction in which the intermediate transfer belt rotates, downstream of the second transfer position and upstream of a first transfer position, at which the first transfer device transfers the toner image onto the intermediate transfer belt, the cleaning device cleaning the intermediate transfer belt; and a charging member that is located upstream of the first transfer position and downstream of the cleaning device in the direction in which the intermediate transfer belt rotates, the charging member having a shape of a roller having a diameter smaller than a diameter of a driving roller that drives the intermediate transfer belt while touching an inner surface of the intermediate transfer belt to rotate the intermediate transfer belt, the charging member charging the intermediate transfer belt by holding the intermediate transfer belt between the charging member and the driving roller and touching an outer surface of the intermediate transfer belt.

BRIEF DESCRIPTION OF THE DRAWINGS

An exemplary embodiment of the present invention will be described in detail based on the following figures, wherein.

DETAILED DESCRIPTION

The following describes an exemplary embodiment of the present invention.

Figure 1:
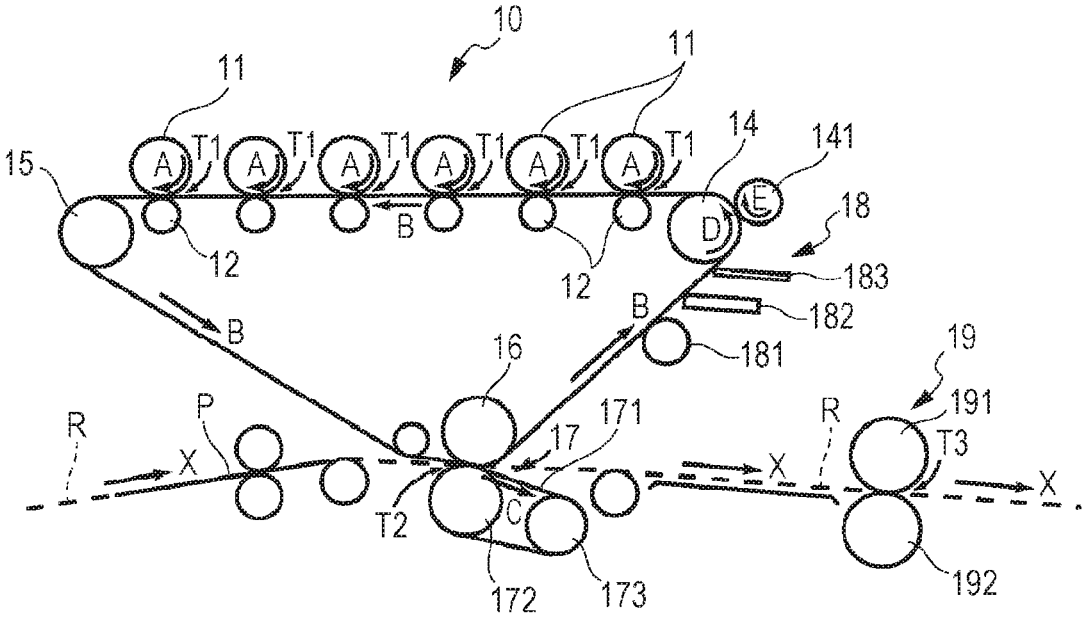
FIG. 1 is a schematic diagram of a configuration of a relevant portion of an image forming apparatus according to an exemplary embodiment of the present invention.

FIG. 1 is a schematic diagram of a configuration of a relevant portion of an image forming apparatus according to an exemplary embodiment of the present invention.

Figure 2:
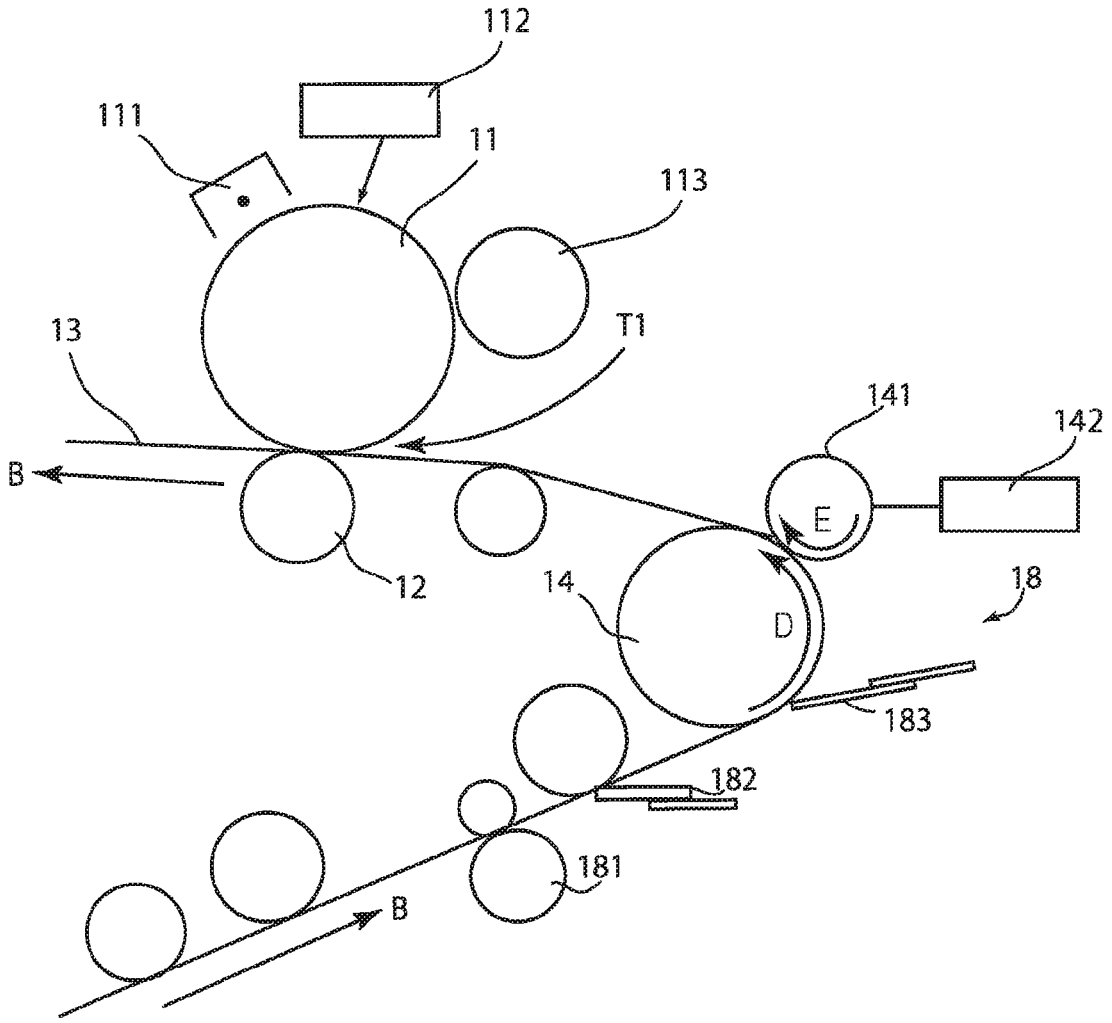
FIG. 2 is a configuration diagram of a portion of an intermediate transfer belt near a driving roller.

An image forming apparatus 10 includes six photoconductors 11, lined in an upper portion of the image forming apparatus 10. Around each of the six photoconductors 11, components such as a charging device 111, an exposure device 112, and a development device 113, which are illustrated in FIG. 2 but not illustrated in FIG. 1, are arranged. The photoconductor 11 has a shape of a drum. Each photoconductor 11 receives a toner image on its peripheral surface while rotating in a direction of arrow A. The toner images formed on the respective photoconductors 11 have different colors.

The image forming apparatus 10 includes an endless intermediate transfer belt 13, disposed so as to be parallel with the lined photoconductors 11 below the photoconductors 11. This intermediate transfer belt 13 is wound around a driving roller 14, a tension roller 15, and a backing roller 16 and is rotated in a direction of arrow B by the driving roller 14.

The toner image formed on each photoconductor 11 is transferred onto the intermediate transfer belt 13 at the corresponding first transfer position T1 with an operation of a corresponding one of first transfer rollers 12.

Here, each photoconductor 11 and the corresponding first transfer roller 12 according to the exemplary embodiment respectively correspond to examples of an image carrier and a first transfer device of the present invention.

The image forming apparatus 10 also includes a second transfer device 17, at a position at which the second transfer device 17 holds the intermediate transfer belt 13 at a position between itself and the backing roller 16. The second transfer device 17 includes an endless transfer belt 171 and two rollers 172 and 173 around which the transfer belt 171 is wound. The transfer belt 171 rotates in a direction of arrow C.

A sheet P is transported in a direction of arrow X along a sheet transport path R via a second transfer position T2, defined between the intermediate transfer belt 13 and the second transfer belt 171. Each toner image on the intermediate transfer belt 13 is transferred onto the sheet P that has been transported to the second transfer position T2 with an operation of the second transfer device 17.

Toner remaining on the intermediate transfer belt 13 after the transfer is removed from the intermediate transfer belt 13 by a cleaner 18.

After the sheet P is subjected to a transfer of the toner image at the second transfer position T2, the sheet P is transported further in a direction of arrow X along the sheet transport path R and passes a fixing position T3, defined between a heating device 191 and a pressing device 192 included in a fixing device 19. While the sheet P is passing the fixing position T3, the sheet P is heated and pressed by the fixing device 19, so that the toner image on the sheet P is fixed to the sheet P. The sheet P on which the image has been formed as a result of this fixing is ejected to the outside of the image forming apparatus 10.

FIG. 2 is a configuration diagram of a portion near the driving roller 14 of the intermediate transfer belt 13.

The intermediate transfer belt 13 rotates in a direction of arrow B upon receipt of a rotational driving force of the driving roller 14 in a direction of arrow D. FIG. 2 illustrates one of the six photoconductors 11 located closest to the driving roller 14, the six photoconductors 11 being illustrated in FIG. 1 and located downstream of the driving roller 14 in a direction in which the intermediate transfer belt 13 rotates (in a direction of arrow B). The corresponding first transfer roller 12 is illustrated at the position at which the first transfer roller 12 faces this photoconductor 11 with the intermediate transfer belt 13 interposed therebetween.

Each photoconductor 11 rotates in a direction of arrow A. A toner image is formed on the photoconductor 11 after the charging device 111 charges the photoconductor 11 with electricity, the exposure device 112 exposes the photoconductor 11 to light to produce an electrostatic latent image, and the development device 113 develops the electrostatic latent image into the toner image. The toner image thus formed is transferred onto the intermediate transfer belt 13 at the corresponding first transfer position T1 of the intermediate transfer belt 13 held between the photoconductor 11 and the first transfer roller 12. The five other photoconductors 11 illustrated in FIG. 1 operate in the same manner. The toner image transferred onto the intermediate transfer belt 13 is transferred onto the sheet P at the second transfer position T2 illustrated in FIG. 1.

Toner or an additive remaining on the intermediate transfer belt 13 subjected to a second transfer is removed from the intermediate transfer belt 13 by the cleaner 18. This cleaner 18 is disposed downstream of the second transfer position T2 (see FIG. 1) and upstream of the first transfer positions T1 in the direction in which the intermediate transfer belt 13 rotates (in a direction of arrow B). This cleaner 18 corresponds to an example of a cleaning device according to the present invention.

The cleaner 18 includes a brush 181, a blade 182, and a scraper 183. The brush 181 rubs off toner or the like adhering to the surface of the intermediate transfer belt 13 to detach the toner or the like from the surface of the intermediate transfer belt 13. The blade 182 is made of rubber and scrapes the toner or the like off the intermediate transfer belt 13. The scraper 183 is made of a thin metal plate and scrapes an additive or the like that has slipped by the blade 182. In this exemplary embodiment, the cleaner 18 including the brush 181, the blade 182, and the scraper 183 thoroughly clean the surface of the intermediate transfer belt 13, so that the intermediate transfer belt 13 is prepared for the subsequent toner image transfer.

The image forming apparatus 10 also includes a charging brush 141, disposed near the cleaner 18. The charging brush 141 is located upstream of the first transfer positions T1 and downstream of the cleaner 18 in the direction in which the intermediate transfer belt 13 rotates (in a direction of arrow B). The charging brush 141 is in contact with the outer surface of the intermediate transfer belt 13 so as to face the driving roller 14, which is in contact with the inner surface of the intermediate transfer belt 13, with the intermediate transfer belt 13 interposed therebetween.

This charging brush 141 is a roller-shaped brush having a diameter smaller than the diameter of the driving roller 14. A constant-current power supply 142 applies a constant current bias across the charging brush 141 and the driving roller 14. While rotating in the direction of arrow E, the charging brush 141 charges the intermediate transfer belt 13 with the same polarity as the polarity with which toner is charged. This charging erases the charging record on the intermediate transfer belt 13, so that occurrence of image defects of the above-described ghosts is avoided.

This charging brush 141 is disposed at a position behind a position at which the intermediate transfer belt 13 is cleaned by the cleaner 18. Thus, an additive or the like is prevented from adhering to the charging brush 141, so that occurrence of image defects of the above-described fine white streaks attributable to the adherence of an additive or the like is avoided.

The charging brush 141 is disposed so as to hold the intermediate transfer belt 13 between itself and the driving roller 14. A bias is applied across the charging brush 141 and the driving roller 14. When a belt or the like is held between two roller-shaped members having different diameters and a bias is applied across these members, the belt or the like held between the roller-shaped members tends to wind itself around the member having a larger diameter. Thus, the intermediate transfer belt 13 more firmly winds itself around the driving roller 14, having a larger diameter. This configuration more reliably prevents the intermediate transfer belt 13 and the driving roller 14 from slipping over each other, so that the intermediate transfer belt 13 rotates more smoothly.

Here, since the cleaner 18 also includes a brush 181, a case is supposed where, instead of disposing the charging brush 141 at the position illustrated in FIG. 2, the brush 181 included in the cleaner 18 is changed into a charging brush and the charging brush is used to rub off toner and to charge the intermediate transfer belt 13 with electricity. In this case, toner or an additive is more likely to adhere to the brush 181 that also performs charging, so that an image defect of fine white streaks is more likely to occur. In addition, this configuration fails to obtain an effect of firm winding of the intermediate transfer belt 13 around the driving roller 14 as a result of disposing the charging brush 141 at the position illustrated in FIG. 2.

In contrast, according to the exemplary embodiment, the charging brush 141 is disposed at the position illustrated in FIG. 2, at which the charging brush 141 faces the driving roller 14. Thus, image defects of both ghosts and fine white streaks are avoided, so that the driving roller 14 more smoothly drives the intermediate transfer belt 13.

The image forming apparatus 10 according to the exemplary embodiment operates in an image formation mode, in which the image forming apparatus 10 forms a toner image and transfers and fixes the toner image onto a sheet, and also in a cleaning mode, in which the image forming apparatus 10 cleans each portion. The charging brush 141 is also cleaned in the cleaning mode. The cleaning mode corresponds to an example of a charging-member cleaning mode according to the present invention. The charging brush 141 is a member that rotates in both of the image formation mode and the cleaning mode. The charging brush 141 rotates faster in the cleaning mode than in the image formation mode. This fast rotation blows off toner or an additive slightly adhering to the charging brush 141, so that occurrence of image defects of fine white streaks in the subsequent operation in the image formation mode is further reliably avoided.

In this exemplary embodiment, the charging brush 141 is used as a charging member that charges the intermediate transfer belt 13 with electricity. The charging member according to the present invention is not limited to a charging brush and may be a charging member having a shape of a roller other than a brush, such as a charging roller.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image carrier that allows an electrostatic latent image to be formed thereon and holds a toner image into which the electrostatic latent image is developed with toner;

an intermediate transfer belt that allows the toner image on the image carrier to be transferred thereto and transports the toner image while rotating;

a first transfer device that transfers the toner image on the image carrier onto the intermediate transfer belt;

a second transfer device that transfers the toner image on the intermediate transfer belt onto a sheet;

a fixing device that fixes, onto the sheet, the toner image that has been transferred onto the sheet;

a sheet transport unit that transports the sheet such that the sheet moves along a transport path via a second transfer position, at which the second transfer device transfers the toner image onto the sheet, and a fixing position, at which the fixing device fixes, onto the sheet, the toner image onto the sheet;

a cleaning device that is located, in a direction in which the intermediate transfer belt rotates, downstream of the second transfer position and upstream of a first transfer position, at which the first transfer device transfers the toner image onto the intermediate transfer belt, the cleaning device cleaning the intermediate transfer belt; and a charging member that is located upstream of the first transfer position and downstream of the cleaning device in the direction in which the intermediate transfer belt rotates, the charging member having a shape of a roller having a diameter smaller than a diameter of a driving roller that drives the intermediate transfer belt while touching an inner surface of the intermediate transfer belt to rotate the intermediate transfer belt, the charging member charging the intermediate transfer belt by holding the intermediate transfer belt between the charging member and the driving roller and touching an outer surface of the intermediate transfer belt.

2. The image forming apparatus according to claim 1, wherein the charging member charges the intermediate transfer belt with a polarity the same as a polarity with which the toner is charged.

3. The image forming apparatus according to claim 2, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

4. The image forming apparatus according to claim 2, wherein the charging member is a brush having a shape of a roller.

5. The image forming apparatus according to claim 4, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

6. The image forming apparatus according to claim 2, further comprising a constant-current power supply that applies a constant current bias to the charging member.

7. The image forming apparatus according to claim 6, wherein the charging member is a brush having a shape of a roller.

8. The image forming apparatus according to claim 7, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

9. The image forming apparatus according to claim 6, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

10. The image forming apparatus according to claim 1, further comprising a constant-current power supply that applies a constant current bias to the charging member.

11. The image forming apparatus according to claim 10, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

12. The image forming apparatus according to claim 10, wherein the charging member is a brush having a shape of a roller.

13. The image forming apparatus according to claim 1, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

14. The image forming apparatus according to claim 1, wherein the charging member is a brush having a shape of a roller.

15. The image forming apparatus according to claim 14, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

16. The image forming apparatus according to claim 1, wherein the image forming apparatus operates in an image formation mode, in which the image forming apparatus forms a toner image and transfers and fixes the toner image onto a sheet, and a charging-member cleaning mode, in which the image forming apparatus cleans the charging member, and wherein the charging member is a member that rotates in the image formation mode and the charging-member cleaning mode, the charging member rotates faster in the charging-member cleaning mode than in the image formation mode.

17. The image forming apparatus according to claim 1, wherein the charging member and the driving roller form a nip together to hold the intermediate transfer belt.

18. The image forming apparatus according to claim 1, wherein the charging member is contacting the intermediate transfer belt along a portion of the intermediate transfer belt is contacting the driving roller.

19. The image forming apparatus according to claim 18, wherein the charging member is a brush having a shape of a roller, and the cleaning device comprises a brush, and a blade or scraper, and the brush is disposed upstream of the blade or scraper.

20. The image forming apparatus according to claim 19, wherein the blade or scraper contacts the intermediate transfer belt along a portion of the intermediate transfer belt is contacting the driving roller.

* * * * *